United States Patent [19]

Bubik et al.

[11] 4,443,300

[45] Apr. 17, 1984

[54] PAPER MAKING MACHINE WITH A FILTER CYLINDER

[75] Inventors: Alfred Bubik, Ravensburg; Siegfried Reutter, Gerbertshaus, both of Fed. Rep. of Germany

[73] Assignee: Escher Wyss GmbH, Ravensburg/Württ, Fed. Rep. of Germany

[21] Appl. No.: 440,083

[22] Filed: Nov. 8, 1982

Related U.S. Application Data

[63] Continuation of Ser. No. 226,228, Jan. 19, 1981, abandoned.

[30] Foreign Application Priority Data

Mar. 18, 1980 [CH] Switzerland ..... 2118/80

[51] Int. Cl.[3] ..... D21F 1/48; D21F 1/76

[52] U.S. Cl. ..... 162/306; 162/318; 162/370

[58] Field of Search ..... 162/203, 208, 210, 217, 162/264, 190, 303, 297, 304, 306, 310, 317, 318, 335, 337, 370

[56] References Cited

U.S. PATENT DOCUMENTS

| | | | |
|---|---|---|---|
| 3,132,990 | 5/1964 | Trufitt | 162/317 |
| 3,876,498 | 4/1975 | Justus | 162/301 |
| 3,985,612 | 10/1976 | Watanabe | 162/304 |
| 4,045,281 | 8/1977 | Wussermann | 162/357 |
| 4,089,739 | 5/1978 | Hildebrand et al. | 162/343 |
| 4,139,412 | 2/1977 | Printz | 162/357 |
| 4,153,504 | 5/1979 | Justus | 162/306 |

*Primary Examiner*—Steve Alvo

*Attorney, Agent, or Firm*—Werner W. Kleeman

[57] ABSTRACT

A paper making machine contains a filter or screen cylinder and an external filter or wire guided over guide rolls, the external filter or wire being trained about the filter cylinder. The stock suspension is introduced by means of a free jet-headbox between the cylinder and the external filter, into an essentially linear portion of the external filter or wire, if desired while carrying out a dewatering operation. The removal of the fiber web or fleece is accomplished directly from the filter cylinder on to a felt web.

10 Claims, 2 Drawing Figures

PAPER MAKING MACHINE WITH A FILTER CYLINDER

This is a continuation of application Ser. No. 226,228, filed Jan. 19, 1981, now abandoned.

BACKGROUND OF THE INVENTION

The present invention relates to a new and improved construction of paper making machine.

Generally speaking, the paper making machine of the present development is of the type comprising a filter or screen cylinder also sometimes referred to as a wire cylinder having a pervious surface, a headbox which serves to form a fiber web or fleece upon the filter cylinder and an outlet gap or slice which is bounded by two lip members terminating at the same region. Additionally, there is provided a withdrawal web for the direct withdrawal of the fiber web or fleece from the filter cylinder.

Such type of paper making machine is known in this technology from the U.S. Pat. No. 4,139,412. The prior art machine is extremely simple and is suitable for the fabrication of multi-ply cardboard in place of the heretofore used suction former, for instance of the type disclosed in the U.S. Pat. No. 3,018,825. It avoids unfavorable properties of such suction former, such as for instance alignment of the fibers of the paper web in the lengthwise direction, something leading to reduced transverse strength.

SUMMARY OF THE INVENTION

It is a primary object of the present invention to provide a new and improved construction of paper making machine working with a filter or wire cylinder, which is not associated with the aforementioned drawbacks and limitations of the prior art constructions.

Another more specific object of the present invention aims at providing a new and improved construction of paper making machine of the previously mentioned type, which with only a slightly increased constructional expenditure, allows for attaining an appreciably greater output and improved quality of the fabricated paper.

Now in order to implement these and still further objects of the invention, which will become more readily apparent as the description proceeds, the paper making machine of the present development is manifested by the features that there is provided an endless filter or screen band, also referred to in the art as a wire, which is guided over guide rolls. This endless filter band or wire is wrapped about the filter cylinder at its circumference along a wrap angle. The endless filter band extends from the region of the headbox up to the region of the withdrawal web.

Due to the provision of the additional filter band there is beneficially obtained an appreciable increase in the dewatering action of the paper making machine and, furthermore, there is rendered possible an increase in the weight of the paper web up to approximately a two-fold value. Additionaly, there is achieved dewatering of the paper web at both sides or faces, on the one hand, at the filter or wire cylinder and, on the other hand, by the action of the external filter band or wire. As a result, there is also improved upon the quality of the fabricated paper. The employed headbox enables uniform distribution and alignment of the paper fibers in the formed paper, so that the strength of the paper web is uniform both in the lengthwise direction and in the transverse direction.

In principle, there is known such type of external filter or wire, for instance from U.S. Pat. No. 3,132,990 and specifically, also as used in conjunction with a similar headbox. However, in this case the formed paper web departs from the cylinder with the filter band and thereafter is transferred by the filter band or wire to the withdrawal or removal web. Apart from the complicated construction of this equipment there also arise additional problems with the separation of the paper web from the filter cylinder, something which can be avoided with the machine of the present invention.

Preferably, the guide roll of the filter band which is situated closest to the withdrawal web can be constituted by a controlled deflection roll having a stationary roll support and a roll shell which is rotatable about such stationary roll support. Between the roll shell and the roll support there are located support or pressure elements which serve to exert a controllable supporting force. Such type roll can have an extremely small diameter, notwithstanding the appreciable tension forces which it must be capable of withstanding, and therefore there can be attained a larger wrapping or training of the filter band about the filter cylinder, the wrap angle $\alpha$ can amount to more than 90°. At the same time, this controlled deflection roll can be beneficially employed for controlling and tensioning the filter band, thereby realizing a further simplification of the paper making machine.

The filter cylinder can be provided with a suction box for forming a suitable negative pressure or vacuum. This suction box extends from the region of the lift-off location of the filter band up to the region of the transfer location of the paper web or fleece onto the withdrawal web. Such arrangement of suction box facilitates the stripping of the paper web from the external or outer filter band or wire, and it additionally serves to fixedly retain the paper web at the cylinder against the action of centrifugal forces, so that the paper making machine also can properly function even when working with extremely high peripheral velocities of the filter cylinder.

It is possible to provide a further suction box suitable for forming a negative pressure or vacuum which is located at the region of the wrap angle of the filter cylinder by the filter band. Such type suction box augments the dewatering of the formed paper web at the filter cylinder. This likewise contributes to an increased output of the paper making machine.

Moreover, the filter or wire cylinder can be provided with a device for rendering more difficult the dewatering operation. Such device can extend from the region of the outlet gap or slice of the headbox at least to the region of the run-on location of the filter band at the filter cylinder. Such type device, for instance constituted by a box in which there prevails an excess pressure in relation to the atmospheric pressure, or a filter or screen table having a solid surface improves the formation of the fiber web or fleece at the starting region in that it prevents too rapid initial dewatering.

With the inventive machine the run-on location of the filter band at the filter cylinder can be dispositioned at the region of the upper half of the filter cylinder, whereas the transfer location of the fiber or paper web at the withdrawal or removal web can be located at the region of the lower half of the filter cylinder. With such type of machine the fiber or paper web can be deposited on the withdrawal web which, for instance, can be constituted by a felt or wire or equivalent structure.

But, it is within the framework and teachings of the invention to resort to a reversed type of arrangement wherein the run-on location of the filter band is disposed at the region of the lower half of the filter cylinder, and the transfer region is located at the region of the upper half of the filter cylinder. In such case the formed fiber web is brought from beneath the filter cylinder onto a felt web or onto a paper layer which is already located upon the felt web.

With the second embodiment the filter band can possess between the headbox and the run-on location a portion or section which extends essentially linearly. At this linearly extending portion there is located, viewed in the direction of movement of the filter band and following the outlet gap or slice of the headbox, a filter or screen table and thereafter a dewatering device. With this embodiment there is possible a pre-dewatering of the paper web before such arrives at the filter cylinder. Consequently, it is possible, under circumstances, to further increase the output of the paper making machine.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been conveniently used for the different embodiments essentially the same reference characters to denote the same or analogous components, and wherein.

DETAILED DESCRIPTION OF THE PREFERRED EMBODIMENTS

Figure 1:
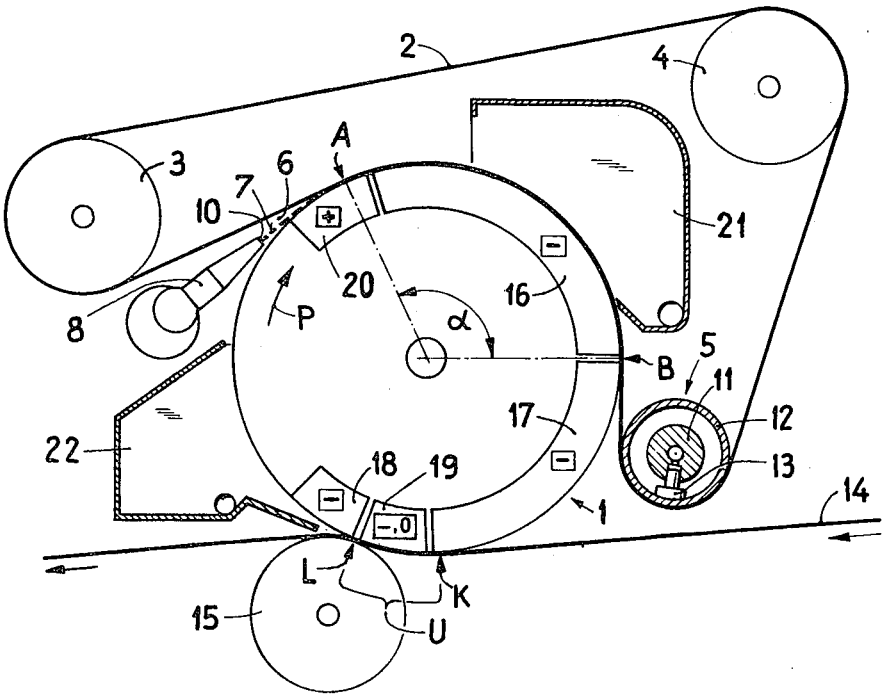
FIG. 1 schematically illustrates a first embodiment of paper making machine according to the invention working with removal of the fiber web from the lower region of the filter cylinder.

Describing now the drawings it is to be understood that only enough of the paper making machine has been illustrated to enable those skilled in the art to readily understand the underlying principles and concepts of the present invention. Turning attention now to FIG. 1, the therein exemplary embodiment of paper making machine will be seen to contain a filter or wire cylinder 1 which, in known matter is designed to have a pervious surface and at its circumference contains a circular filter or wire which is shrunk thereon or otherwise appropriately fixed thereto. The filter cylinder 1 has operatively associated therewith an endless filter or screen band 2—also referred to in the art as an endless wire—which is guided over the guide rolls 3, 4 and 5. The filter band or wire 2 travels onto the cylinder 1, which rotates during operation in the direction of the arrow P, at a substantially linear-shaped run-on location A and departs from the filter cylinder 1 at a likewise linear-shaped removal location B. Between both of these locations A and B there is present a wrap angle $\alpha$ which is greater than 90°.

Forwardly of the run-on location A the surface of the filter cylinder 1 and the filter band 2 form a substantially wedge-shaped intermediate space 6 into which there is directed the fiber stock suspension jet 7 of a free jet-headbox 8. The stock jet 7 departs from the headbox 8 cooperating with the filter cylinder 1 at a headbox region, through a not further shown but conventional outlet gap 10, also known as a slice, located at the end of the headbox 8. The free jet-headbox 8 is of conventional design and can be constructed, for instance, in accordance with the teachings of the U.S. Pat. No. 4,089,739, by way of example and not limitation.

In the embodiment under discussion the guide roll 5 is constituted by a controlled deflection roll containing a stationary roll support 11 and a roll shell 12 which is rotatable about such stationary roll support 11. Guided in the roll support 11 are hydrostatic pressure or support elements 13 which serve to support the roll shell 12 against the filter forces acting upon the filter band or wire 2, while simultaneously permitting a rotational movement of the roll shell 12 about the roll support 11. Such controlled deflection roll is likewise well known in the art and, for instance, can be designed according to the teachings of U.S. Pat. No. 3,802,004 and U.S. Pat. No. 3,885,283. However, it is to be expressly understood that instead of using at this location of the paper making machine such type controlled deflection rolls it would be possible to employ other types of controlled deflection rolls or also standard rolls. The use of a controlled deflection roll at this location of the equipment is associated with the advantage that in contrast to a solid roll it can possess an appreciably smaller diameter, with the result that the wrap angle of the filter band 2 at the filter cylinder 1 can be chosen to be larger. At the same time it also can be used for controlling the tension of the filter band or wire 2 and for insuring for the linear travel of such filter band.

At the lower region of the machine there travels a withdrawal or removal web 14, for instance constituted by a wire or a felt or equivalent structure. This removal or withdrawal web 14 is guided with the aid of a felt guide roll 15 in a manner such that it travels onto the filter cylinder 1 at a felt run-on location K and departs from such filter cylinder 1 at a run-off location L. Between the locations K and L there is arranged a transfer region U.

As will be further evident by reverting to FIG. 1, the filter cylinder 1 can be provided with suction boxes and blow boxes.

In particular, there is located for instance within the wrap angle $\alpha$ a suction box 16 which has assigned thereto the task of augmenting dewatering of the fiber fleece or web formed between the filter cylinder 1 and the filter band 2, this dewatering being accomplished towards the inside in the direction of the interior of the filter cylinder 1.

Between the outbound or lift-off location B of the filter band 2 from the filter cylinder 1 and the run-on or inbound location K of the felt band 14, i.e. the withdrawal or removal band, there is located a suction box 17. This suction box 17 augments the retention of the paper or fiber web upon the filter cylinder 1 during lifting-off of the filter band 2 and also counteracts the effects of the centrifugal force of the filter cylinder 1.

Additionally, there can be provided following the run-off or lift-off location L of the felt band 14 a suction box 18 which prevents any premature spraying of water located in the bores of the filter cylinder 1 and which could damage the formed paper web.

Additionally, it is possible to arrange a blow or blower box 20 forwardly of the run-on location A of the filter band or wire 2, which prevents any premature dewatering of the stock suspension of the jet 7 at the filter cylinder 1, and thus, augments an orderly formation of the fiber web upon the outer wire or filter of the filter cylinder 1. Finally, the paper making machine further contains catch boxes 21 and 22 for receiving the filtered water which has been expressed out of the stock suspension, as well as a box 19 which can be constituted by a suction box or can be at atmospheric pressure.

The embodiment of FIG. 2 differs from that disclosed heretofore in conjunction with the description of FIG. 1 primarily by virtue of the fact that with this embodiment the headbox 8 is located below the filter or wire cylinder 1, whereas the withdrawal or removal felt 14 or the like is located above the cylinder 1. A further difference resides in the fact that with the arrangement of FIG. 2 there is provided forwardly of the run-on location A of the filter band 2 a filter or wire section 2' which is essentially straight or linear, at which, with the illustrated embodiment viewed in the direction of movement of the filter band 2, there is arranged following the headbox 8 a solid filter or screen table 30 and after such a dewatering device 31 in the form of at least one suction box. The suction box can be provided in conventional manner with foils 32.

Figure 2:
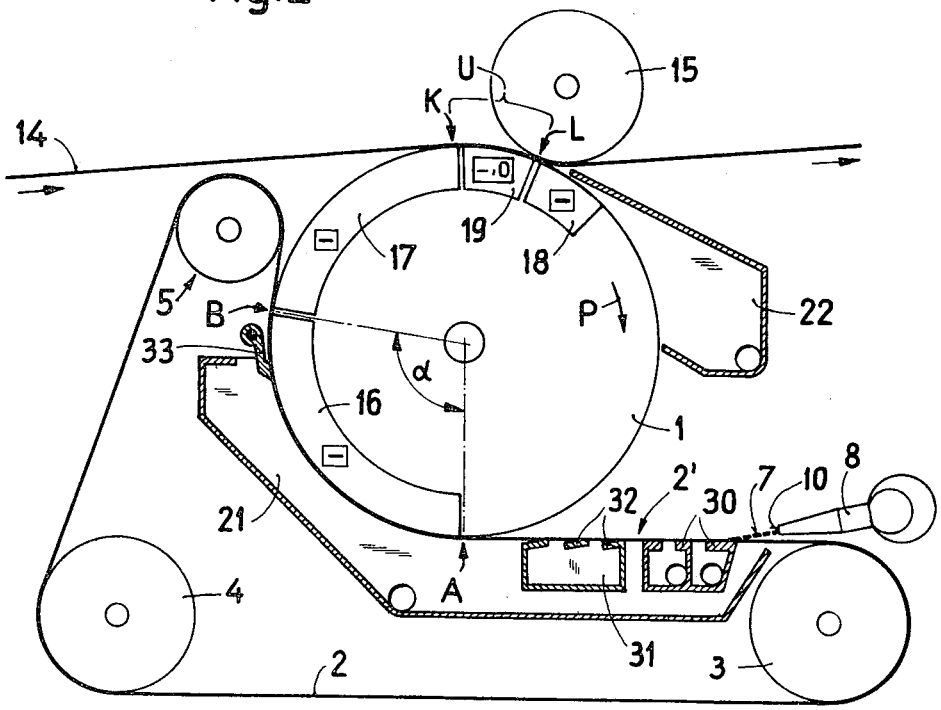
FIG. 2 illustrates a corresponding schematic showing of paper making machine according to a second embodiment wherein the fiber web is removed at the upper region of the filter cylinder.

As also will be apparent by inspecting FIG. 2, there is located at the region of the lift-off or run-off location B of the filter band 2 from the filter cylinder 1 a stripper or scraper 33 which is assigned thereto the task of stripping water adhering to the filter band 2 and depositing such in the catch container or receiver 21 or the like.

The headbox 8 illustrated in FIGS. 1 and 2 is a so-called free jet-headbox, the lips 10 or the like of which form an outlet gap or slice, and both of these lips or lip members terminate at the same region. This means that they either terminate symmetrically with respect to the flow of the stock suspension or are slightly shifted in relation to one another. The arrangement is preferably perfected such that the suspension jet 7, after departing from the outlet gap 10, i.e. the gap formed by the lips, extends through the air at both sides or faces of such suspension jet 7 over a short distance. By virtue of such design of headbox there is obtained a particularly uniform alignment of the fibers in all directions within the formed paper web, in contrast to the conventional lip-headboxes used at suction formers where there is unavoidable a certain alignment of the fibers of stock suspension in the flow direction.

Although in both FIGS. 1 and 2 of the drawings there has been illustrated in each case a paper making machine having only one former, i.e. containing a cylinder 1 and a headbox 8, it should be understood that along a withdrawal or removal web 14 there can be arranged a number of such type formers, for instance for fabricating multi-ply cardboard or paper. In both cases there also can be used headboxes which inherently form a number of layers or fibers of different quality.

Finally, the linear section or portion 2' of the filter band or wire 2 of the arrangement of FIG. 2 need not extend as illustrated, rather can be inclined in the one or other direction in relation to the horizontal. This wire portion also can however be dispensed with. In this case the suspension jet 7 is directed in the same manner as in the embodiment of FIG. 1 into the wedge-shaped space between the filter cylinder 1 and the filter band or wire 2.

While there are shown and described present preferred embodiments of the invention, it is to be distinctly understood that the invention is not limited thereto, but may be otherwise variously embodied and practiced within the scope of the following claims. Accordingly,

What I claim is:

1. A paper making machine comprising:

a filter cylinder having a pervious surface;

a headbox cooperating with said filter cylinder at a headbox region and serving for forming a fiber web upon said filter cylinder;

a withdrawal web for the direct removal of the fiber web from the filter cylinder;

a plurality of guide rolls;

an endless filter band guided over said plurality of guide rolls;

said endless filter band being guided along said filter cylinder and being trained about said filter cylinder at its circumference over a predetermined wrap angle which extends between a run-on location and a lift-off location for said endless filter band;

said endless filter band being guided from the region of said headbox towards a run-on location for said withdrawal web;

a first suction box extending approximately up to said lift-off location for said filter band for forming a negative pressure and provided for said filter cylinder;

said fiber web departing from the filter cylinder and being deposited at the withdrawal web at a predetermined transfer region located after said run-on location for the withdrawal web;

said filter band defining said lift-off location at a location where it runs-off the filter cylinder; and a second suction box extending from the region of the lift-off location of the filter band approximately up to a location defining said run-on location of the withdrawal web.

2. The paper making machine as defined in claim 1, wherein:

a predetermined one of said plurality of guide rolls for the filter band is situated closest to said withdrawal web;

said predetermined one of said guide rolls comprising a controlled deflection roll;

said controlled deflection roll containing a stationary roll support and a roll shell rotatable about said stationary roll support; and support elements located between said roll shell and said stationary roll support and serving to exert a controllable support force.

3. The paper making machine as defined in claim 1, wherein:

said filter cylinder is structured to cooperate with said endless filter band such that there is simultaneously accomplished dewatering of the fiber web to both sides over at least a portion of the circumference of the filter cylinder between the run-on location and said lift-off location for said filter band.

4. The paper making machine as defined in claim 1, further including:

means co-acting with said filter cylinder for rendering more difficult dewatering of the fiber web;

said headbox having an outlet gap; and said rendering means extending from a region near to the outlet gap of the headbox at least to the region of said run-on location of the endless filter band at said filter cylinder.

5. The paper making machine as defined in claim 1, wherein:

the endless filter band runs onto the filter cylinder at said run-on location and runs off the filter cylinder at said lift-off location;

said run-on location of the endless filter band at the filter cylinder being located at the region of the upper half of the filter cylinder;

said filter cylinder cooperating with said withdrawal web at the predetermined transfer region; and said predetermined transfer region for the fiber web to the withdrawal web being located at the lower half of the filter cylinder.

6. The paper making machine as defined in claim 5, wherein:

said headbox comprises a free jet-headbox having an outlet gap for a stock suspension in jet form; and said stock suspension in jet form has opposite faces and after departing from the outlet gap of the headbox, travels through the air at both faces of said stock suspension in jet form along a short path of travel.

7. The paper making machine as defined in claim 1, wherein:

said endless filter band runs onto the filter cylinder at said run-on location;

said filter cylinder cooperates with the withdrawal web at said predetermined transfer region for transferring the fiber web from the filter cylinder to the withdrawal web;

said run-on location of the endless filter band is located at the region of the lower half of the filter cylinder; and said predetermined transfer region is located at the region of the upper half of the filter cylinder.

8. The paper making machine as defined in claim 7, wherein:

said endless filter band possesses an essentially linear extending portion located between the headbox and the run-on location;

said headbox has an outlet gap;

a filter table is located following the outlet gap of the headbox viewed with respect to the direction of movement of the endless filter band; and a dewatering device is arranged after the filter table.

9. The paper making machine as defined in claim 1, wherein:

said predetermined wrap angle amounts to at least 90°.

10. The paper making machine as defined in claim 1, wherein:

said headbox has an outlet gap constituted by two lip members terminating essentially at the same region.

* * * * *